US011396094B2

(12) United States Patent
Kondou et al.

(10) Patent No.: US 11,396,094 B2
(45) Date of Patent: Jul. 26, 2022

(54) DRIVING TOOL WITH REACTION ABSORBING MECHANISM

(71) Applicant: MAX CO., LTD., Tokyo (JP)

(72) Inventors: Yoshihiko Kondou, Tokyo (JP); Kouji Kubo, Tokyo (JP)

(73) Assignee: MAX CO., LTD., Tokyo (JP)

( * ) Notice: Subject to any disclaimer, the term of this patent is extended or adjusted under 35 U.S.C. 154(b) by 469 days.

(21) Appl. No.: 16/445,589

(22) Filed: Jun. 19, 2019

(65) Prior Publication Data

US 2019/0299379 A1 Oct. 3, 2019

Related U.S. Application Data

(63) Continuation of application No. 15/297,872, filed on Oct. 19, 2016, now Pat. No. 10,377,026, which is a continuation of application No. 14/722,578, filed on May 27, 2015, now Pat. No. 9,505,115, which is a continuation of application No. 13/369,484, filed on Feb. 9, 2012, now Pat. No. 9,302,381.

(51) Int. Cl.
*B25C 1/00* (2006.01)
*B25C 1/06* (2006.01)

(52) U.S. Cl.
CPC ..... *B25C 1/00* (2013.01); *B25C 1/008* (2013.01); *B25C 1/06* (2013.01)

(58) Field of Classification Search
CPC ..... B25C 1/00; B25C 1/06; B25C 1/008
See application file for complete search history.

(56) References Cited

U.S. PATENT DOCUMENTS 3,610,505 A * 10/1971 Males ..... B25C 5/10 227/127
4,630,687 A * 12/1986 Dummermuth ..... B25D 9/06 173/128
7,410,085 B2 * 8/2008 Wolf ..... B25C 1/06 173/117
7,513,407 B1 * 4/2009 Chang ..... B25C 1/06 173/202
8,561,869 B2 * 10/2013 Towfighi ..... B25C 1/06 227/130
2008/0121404 A1 * 5/2008 Spasov ..... B25C 1/06 173/202
2008/0237294 A1 * 10/2008 Tanimoto ..... B25C 1/06 227/129

(Continued)

FOREIGN PATENT DOCUMENTS

CN 2649269 Y 10/2004
CN 101274425 A 10/2008

(Continued)

OTHER PUBLICATIONS

JP Office Action dated Nov. 5, 2019 from corresponding Japanese patent application No. 2018-229793.

*Primary Examiner* — Praachi M Pathak
(74) *Attorney, Agent, or Firm* — Faegre Drinker Biddle & Reath LLP

(57) ABSTRACT

A driving tool is provided with a driver for driving out a fastener from a nozzle, a balancer, and a balancer biasing member for biasing the balancer in a direction away from the nozzle. The balancer moves in the direction away from the nozzle by a biasing force of the balancer biasing member when the driver moves toward the nozzle.

4 Claims, 21 Drawing Sheets

(56) References Cited

U.S. PATENT DOCUMENTS

| | | | | |
|---|---|---|---|---|
| 2008/0296339 | A1* | 12/2008 | Fielitz | B25C 1/06 227/107 |
| 2009/0078734 | A1 | 3/2009 | Chang | |
| 2010/0001032 | A1* | 1/2010 | Miescher | B25C 1/008 227/8 |

FOREIGN PATENT DOCUMENTS

| | | | |
|---|---|---|---|
| EP | 1980369 | A2 | 10/2008 |
| JP | S57-38777 | A | 3/1982 |
| JP | UM-A-S57-038777 | | 3/1982 |
| JP | 62-5888 | Y2 | 2/1987 |
| JP | H5-261677 | A | 10/1993 |
| JP | H9-295283 | A | 11/1997 |
| JP | 2010-228084 | A | 10/2010 |
| JP | 2011-025362 | A | 2/2011 |

* cited by examiner

DRIVING TOOL WITH REACTION ABSORBING MECHANISM

CROSS-REFERENCE TO RELATED APPLICATIONS

This is a continuation application of copending application Ser. No. 15/297,872, filed on Oct. 19, 2019, which is a continuation of copending application Ser. No. 14/722,578, filed on May 27, 2015, which issued as U.S. Pat. No. 9,505,115 on Nov. 29, 2016, which is a continuation of copending application Ser. No. 13/369,484, filed on Feb. 9, 2012, which issued as U.S. Pat. No. 9,302,381 on Apr. 5, 2016. The copending and prior application Ser. Nos. 15/297,872, 14/722,578, and 13/369,484 are incorporated by reference herein in their entireties.

BACKGROUND OF THE INVENTION

Field of the Invention

The present invention relates to a driving tool.

Related Art

As types of driving tools, for example, a type in which a tool is driven by a compressed air, and a type in which a tool is driven by a spring force are known.

JP-A-09-295283 discloses a spring drive type nailing machine which can sequentially drive out nails stored in a magazine using a plunger normally biased downward by a spring and a driver fixed to the plunger.

In the above type driving tool, in the case that a nose portion of the driving tool is separated from a driven workpiece due to a reaction on driving, a nail cannot be sufficiently driven or a driven mark caused by the driver off the nail can be left on the workpiece.

To prevent such reaction, the nose portion of the driving tool must be strongly pressed against the workpiece. However, when the nose portion is strongly pressed against the workpiece, the nose portion can damage the workpiece and also can cause an operator to get tired.

SUMMARY OF THE INVENTION

One or more embodiments and modifications thereof of the invention provide a driving tool having a mechanism for absorbing a reaction on driving in order to provide a sufficient driving force with a small pressing force against a workpiece.

BRIEF DESCRIPTION OF THE DRAWINGS

FIG. 4 (*b*) is a side view of the plunger unit.

FIG. 10(*b*) is a (partially omitted) section view taken along the 10B-10B line shown in FIG. 10(*a*).

FIG. 14(*b*) is a side view of a plunger unit including a vibration isolator, according to a first modification of the embodiment.

FIG. 19(*b*) is a section view thereof taken along the 19B-19B line shown in FIG. 19(*a*).

FIG. 20(*b*) is a section view thereof when viewed from above. FIG. 20(*c*) is a section view thereof when viewed from side.

DETAILED DESCRIPTION OP THE EMBODIMENTS

Description will be given below of an embodiment and modifications thereof with reference to the accompanying drawings.

The embodiment and the modifications described herein are not intended to limit the invention but only to exemplify the invention, and all features or combinations of the features of the embodiment and the modifications are not always essential to the invention.

Figure 1:
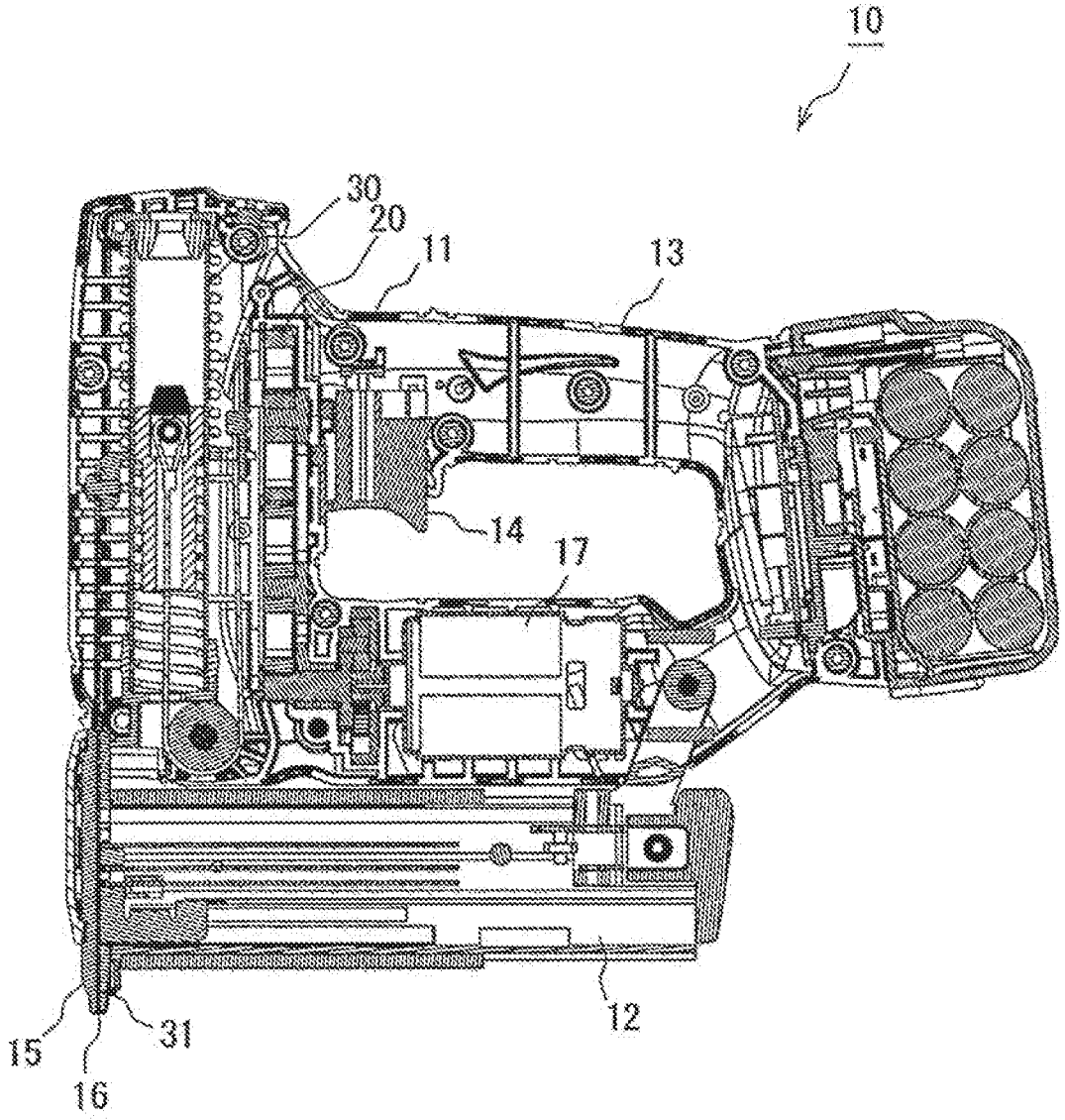
FIG. 1 is a section view of a driving tool.

A driving tool 10 according to the embodiment is a spring drive type nailing machine for carrying out its driving operation using a spring force, while it strikes out a nail as a fastener. The driving tool 10, as shown in FIG. 1, includes, within its housing 11, a plunger unit 30 connected to a driver 31 for driving out the nail, a drive mechanism 20 for actuating the plunger unit 30, a magazine 12 storing therein connected nails (connected staples) to be driven out by the driver 31, and so on.

The magazine 12 includes a nose portion 15 formed in its front end portion, while the leading one of the connected nails stored in the magazine 12 is supplied to the nose portion 15 by a supply device (not shown). The leading nail supplied to the nose portion 15 is driven out from a nozzle 16 formed in the leading end of the nose portion 15. The driver 31 of this embodiment is formed as part of the plunger unit 30 and, when the plunger unit 30 is operated, the driver 31 is caused to slide toward the nozzle 16 to thereby drive out the nail supplied to the nose portion 15 from the nozzle 16.

Figure 2A:
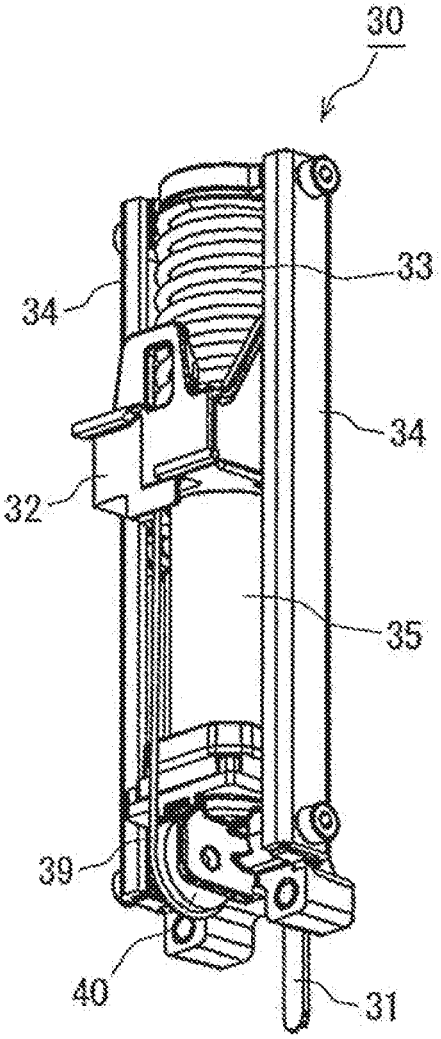
FIGS. 2 (*a*) and 2 (*b*) are external views of a plunger unit.
Figure 2B:
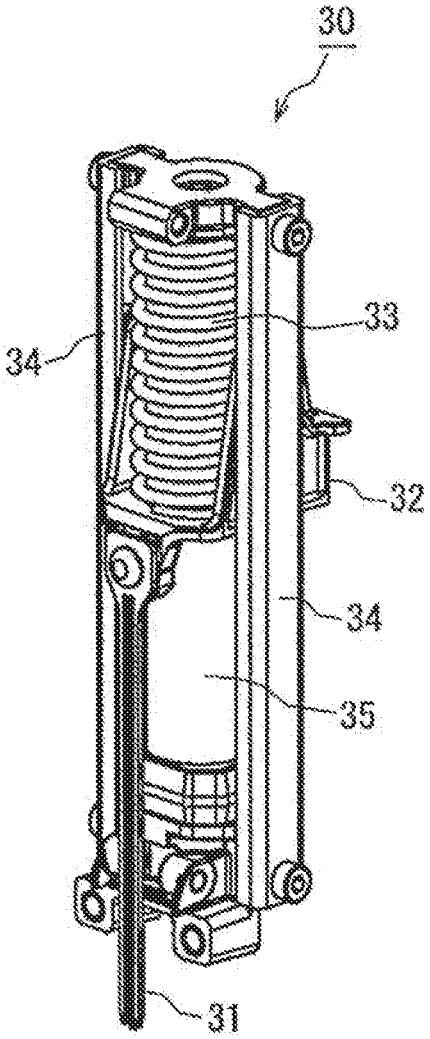

The plunger unit 30 is structured in an elongated bar-like unit such that, as shown in FIG. 2 (*a*) and FIG. 2 (*b*), two plunger guides 34 are fixed respectively to the two sides of a cylindrical pipe 35 functioning as a balancer guide. A plunger 32 is slidably mounted on the outer surface of the pipe 35, while a plunger biasing member 33 for normally biasing the plunger 32 toward the nozzle 16 is also mounted on the outer surface thereof.

Figure 4A:
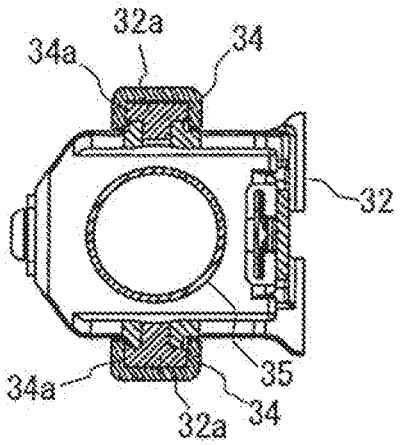
FIG. 4(*a*) is a section view of the plunger unit taken along 4A-4A line shown in FIG. 4 (*b*).
Figure 4B:
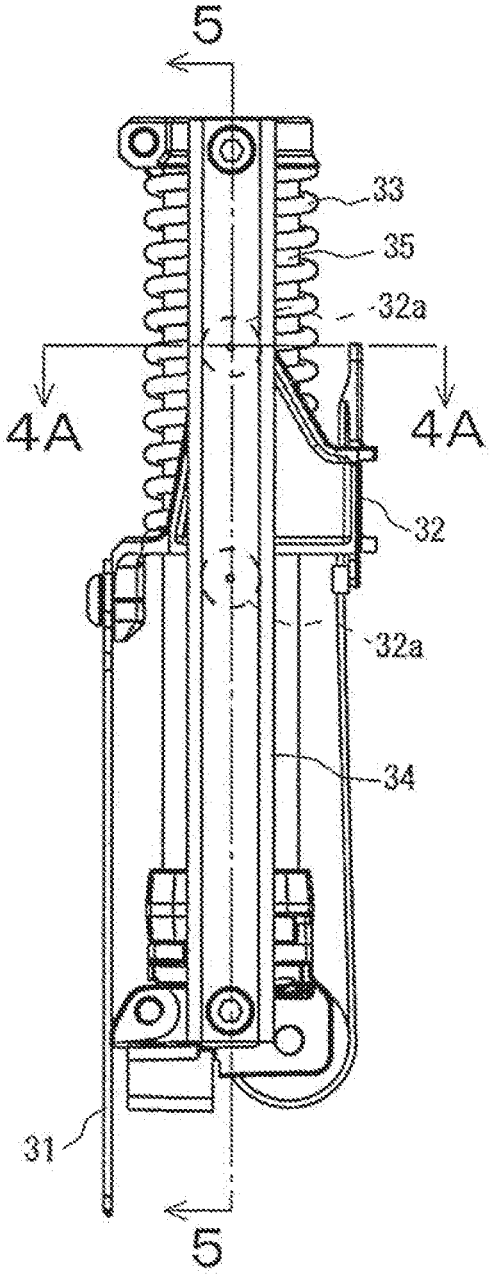

Here, the plunger guide 34 is used to guide the sliding movement of the plunger 32 and, as shown in FIGS. 4(*a*) to 5, it has a rail portion 34*a* formed in its inside facing the pipe 35 and extending in its longitudinal direction.

The plunger unit 30 is fixed within the housing 11 such that the longitudinal direction of the pipe 35 can be parallel to the nail drive-out direction and the driver 31 can become most distant from the grip 13 (in other words, the pipe 35 can be situated nearer to the grip 13 than the driver 31).

The plunger 32 includes in its side portion a driver connecting portion 32*b* for connecting the driver 31 thereto. The driver 31 is connected to this driver connecting portion 32*b* and thus it is able to slide to the sliding movement of the plunger 32.

Figure 3A:
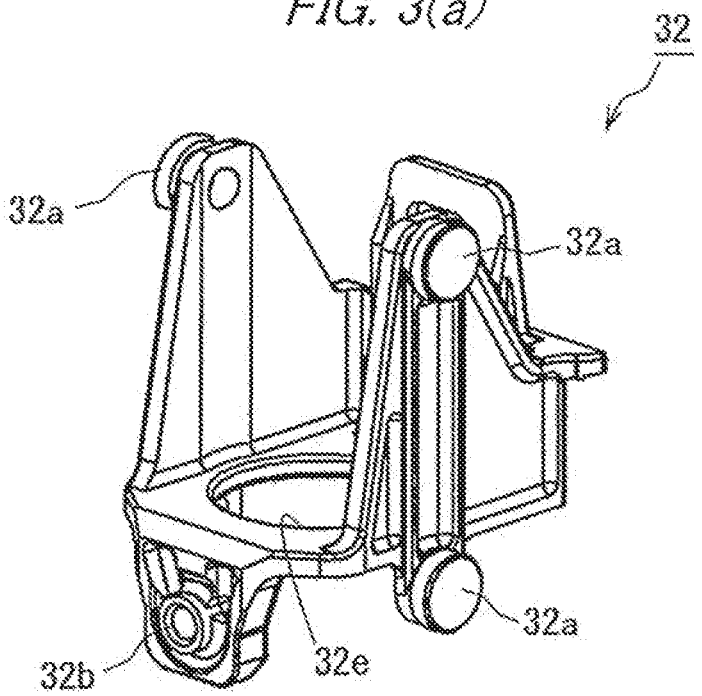
FIGS. 3(*a*) and 3(*b*) are external views of a plunger.
Figure 3B:
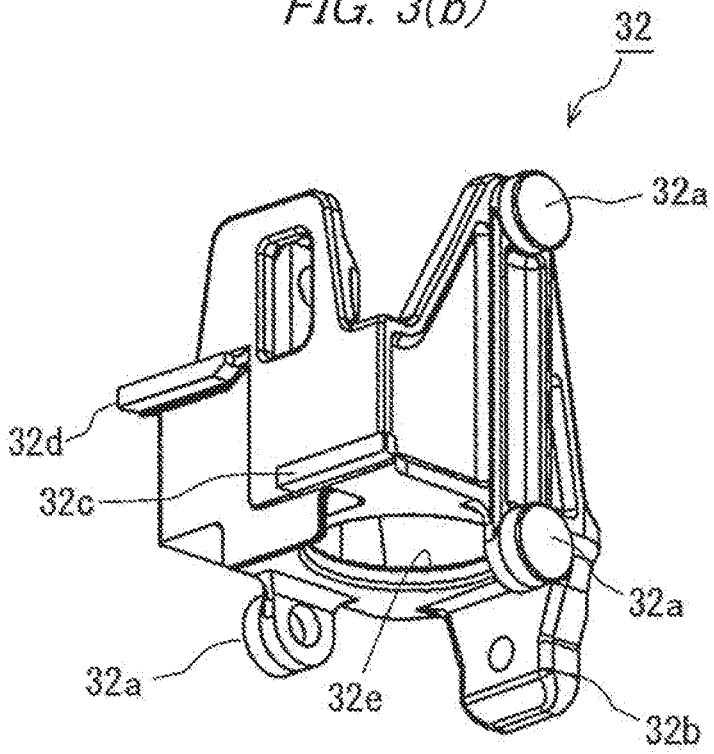

The plunger 32, as shown in FIGS. 3(*a*) and 3(*b*), has a pipe hole 32*e* which is opened up in its center and through which the pipe 35 can be penetrated. On the wall portions of both sides of the pipe hole 32*e*, there are provided guide rollers 32*a*. Each guide roller 32*a*, as shown in FIG. 4 (*a*), slides within the rail portion 34*a* of the plunger guide 34. The plunger 32, due to provision of the pipe hole 32*e* and guide rollers 32*a*, can be guided to slide along the pipe 35 and plunger guide 34.

The plunger 32 has first and second engaging portions 32*c* and 32*d* for engagement with the drive mechanism 20 which, as shown in FIGS. 3(*a*) and 3(*b*), are respectively provided on and projected from its side portion. These first and second engaging portions 32*c* and 32*d* are disposed on the opposite side (on the drive mechanism 20 side) to the side where the driver connecting portion 32*b* is disposed. Here, the first and second engaging portions 32*c* and 32*d* are disposed respectively at mutually different height positions (positions with respect to the nozzle 16). That is, as shown in FIG. 3 (*b*), the first engaging portion 32*c* is disposed at a position nearer to the nozzle 16 than the second engaging portion 32*d*. Thus, the first and second engaging portions 32*c* and 32*d* are disposed alternately with respect to the sliding direction of the plunger 32.

Figure 6:
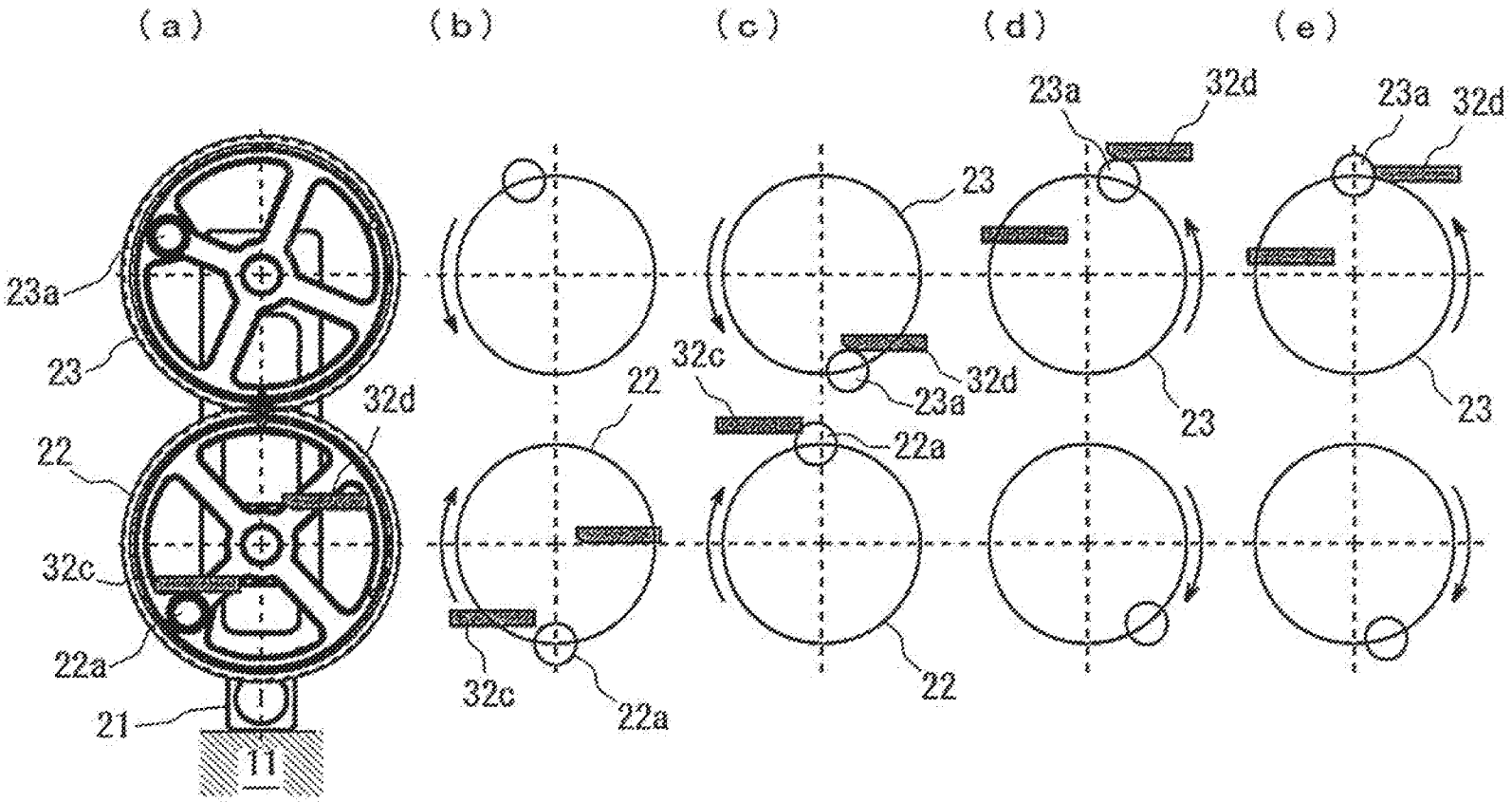
FIG. 6 is an explanatory view to show how the plunger is pushed up by a drive mechanism.

The drive mechanism 20 for pushing up the plunger 32 against the biasing force of the plunger biasing member 33, as shown in FIG. 6, includes multiple gears. The multiple gears can be rotated by the driving force of a motor 17. The motor 17 can be operated when a trigger 14 is operated and its operation will continue until a micro switch (not shown) detects that the plunger 32 has moved to a given position.

Here, within the driving tool 10, there is provided a control apparatus (not shown) including a CPU, a RAM and the like, while the control apparatus controls the driving of the motor 17 according to input signals from the trigger 14 and micro switch.

The drive mechanism 20 rotates the gears in engagement with the plunger 32, thereby pushing up the plunger 32. And, when the engagement of the gears with the plunger 32 is removed, the plunger 32 is caused to move due to the biasing force of the plunger biasing member 33, whereby the driver 31 connected to the plunger 32 is slid toward the nozzle 16 for driving out the nail.

Specifically, in the drive mechanism 20, as shown in (a) of FIG. 6, on a torque gear plate 21 fixed to the housing 11, there are pivotally supported first and second torque gears 22 and 23 in such a manner that they can be rotated respectively. Here, the first and second torque gears 22 and 23 are arranged side by side along the sliding direction of the plunger 32, while the first torque gear 22 is disposed nearer to the nozzle 16 than the second torque gear 23. Thus, the plunger 32 is engaged sequentially with the first and second torque gears 22 and 23 in this order to be thereby lifted up gradually.

(b) of FIG. 6 shows a state where the plunger 32 exists at its bottom dead center position (a state where the driving-out of the nail by the driver 31 is completed). When the first and second torque gears 22 and 23 are rotated from this state, the torque roller 22*a* of the first torque gear 22 is engaged with the first engaging portion 32*c* of the plunger 32.

As shown in (c) of FIG. 6, the plunger 32 is lifted up by the first torque gear 22 with the above engagement maintained. When the first torque gear 22 is rotated up to a position where the torque roller 22*a* comes to its upper-most position, the engagement between the torque roller 22*a* and first engaging portion 32*c* is removed. At the then time, before the engagement between the torque roller 22*a* and first engaging portion 32*c* is removed, the torque roller 23*a* of the second torque gear 23 is engaged with the second engaging portion 32*d* of the plunger 32.

As shown in (d) of FIG. 6, with the above engagement maintained, the plunger 32 is lifted up by the second torque gear 23 and is thereby moved up to its top dead center position.

After then, as shown in (e) of FIG. 6, when the second torque gear 23 is further rotated up to a position where the torque roller 23*a* comes to its upper-most position, the engagement between the torque roller 23*a* and second engaging portion 32*d* is removed. Thus, since the plunger 32 is biased by the plunger biasing member 33, it is moved down to its bottom dead center position shown in (b) of FIG. 6. Consequently, the driver 31 connected to the plunger 32 is caused to slide toward the nozzle 16 for driving out the nail.

Here, in this embodiment, the plunger 32 normally waits at its top dead center position shown in (d) of FIG. 6. When the trigger 14 is operated, the drive mechanism 20 is operated to move the plunger 32 sequentially through the states respectively shown in (e) to (b) and (b) to (c) of FIG. 6 and, after then, the plunger 32 waits again at the top dead center position shown in (d) of FIG. 6.

That is, when the trigger 14 is operated, on receiving this operation signal, the control apparatus starts to drive the motor 17. Thus, when the gear is rotated to a position shown in (e) of FIG. 6, the nail driving operation is carried out. And, also after completion of the nail driving operation, the control apparatus drives the motor on. Consequently, when the plunger 32 moves up to the top dead center position shown in (d) of FIG. 6, the above-mentioned micro switch is depressed by the plunger 32. On receiving the signal of the micro switch, the control apparatus controls the motor 17 to stop its driving operation.

Here, the plunger unit 30 of this embodiment includes a reaction absorbing mechanism for absorbing the reaction to be generated in the above nail driving operation.

Figure 5:
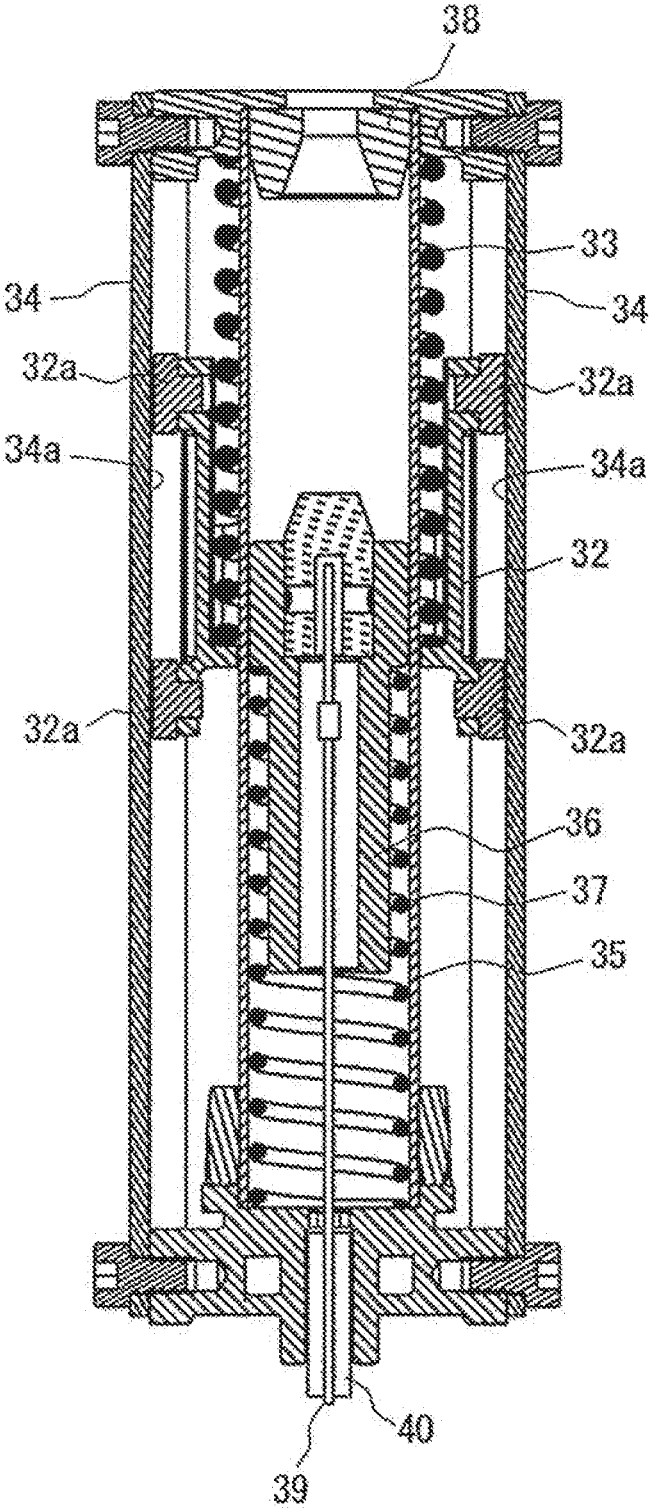
FIG. 5 is a section view of the plunger unit taken along 5-5 line shown in FIG. 4(*b*).

The reaction absorbing mechanism, as shown in FIG. 5, includes a balancer 36 disposed slidably within the pipe 35 and a balancer biasing member 37 for biasing the balancer 36 in the direction away from the nozzle 16.

The balancer 36 is a cylindrical metal member formed to follow the inside diameter of the pipe 35 and can slide inside the pipe 35. Here, as described above, since the pipe 35 is disposed parallel to the nail drive-out direction, the balancer 36 to slide within this pipe 35 is formed to slide parallel to the driver 31.

The balancer biasing member 37 is a spring mechanism constituted of a compression spring which is disposed within the pipe 35 and can be operated there. The balancer biasing member 37 is disposed nearer to the nozzle 16 than the balancer 36 and biases the balancer 36 in the direction away from the nozzle 16.

Here, in this embodiment, the pipe 35 is formed to have a cylindrical shape with its outer surface closed. However, instead, the pipe 35 may also be formed such that it includes a slit or an opening in its outer surface, or it may be formed to have a prism shape or other shapes.

The balancer 36 is connected to the plunger 32 through a string-shaped wire 39 and thus, when the plunger 32 moves, it can be moved in linking with the plunger 32. Specifically, since the direction of a force to be applied to the wire 39 by a pulley 40 provided as a direction changing portion is changed about 180°, when the plunger 32 is pushed up by the drive mechanism 20 and the driver 31 is thereby slid in the direction away from the nozzle 16, the balancer 36 is pulled and moved by the wire 39 in the direction of the nozzle 16. Thus, the balancer biasing member 37 is compressed to thereby store a spring force therein.

When the plunger 32 is released from the drive mechanism 20 and the driver 31 is thereby slid toward the nozzle 16 to carry out a nail driving operation, the pull by the wire 39 is removed. Therefore, the balancer 36 is biased and moved by the balancer biasing member 37 in the direction away from the nozzle 16.

The reaction absorption in this embodiment is carried out by the reaction due to the bias of the balancer biasing member 37. Now, description will be given below specifically of the mechanism of the reaction absorption with reference to the operation of the plunger unit 30.

Figure 7:
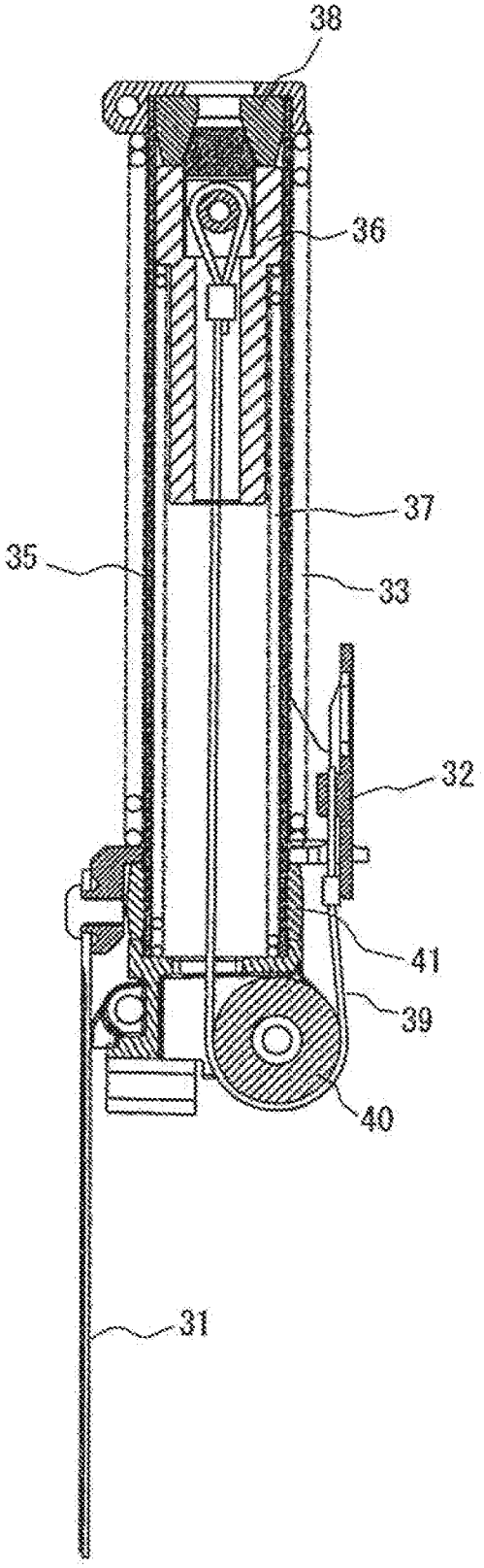
FIG. 7 is a section view of the plunger unit, showing a state where the plunger exists at its bottom dead center position.

FIG. 7 shows the plunger unit 30 with the plunger 32 at the bottom dead center position. In this state, the plunger 32 is biased by a plunger biasing member 33 toward the nozzle 16 and is pressed against a rubber-made bumper 41. Also, the balancer 36 is biased by the balancer biasing member 37 in the direction away from the nozzle 16 and is pressed against a rubber-made balancer stopper 38. In this case, the wire 39 is pulled almost with no loosening.

Figure 8:
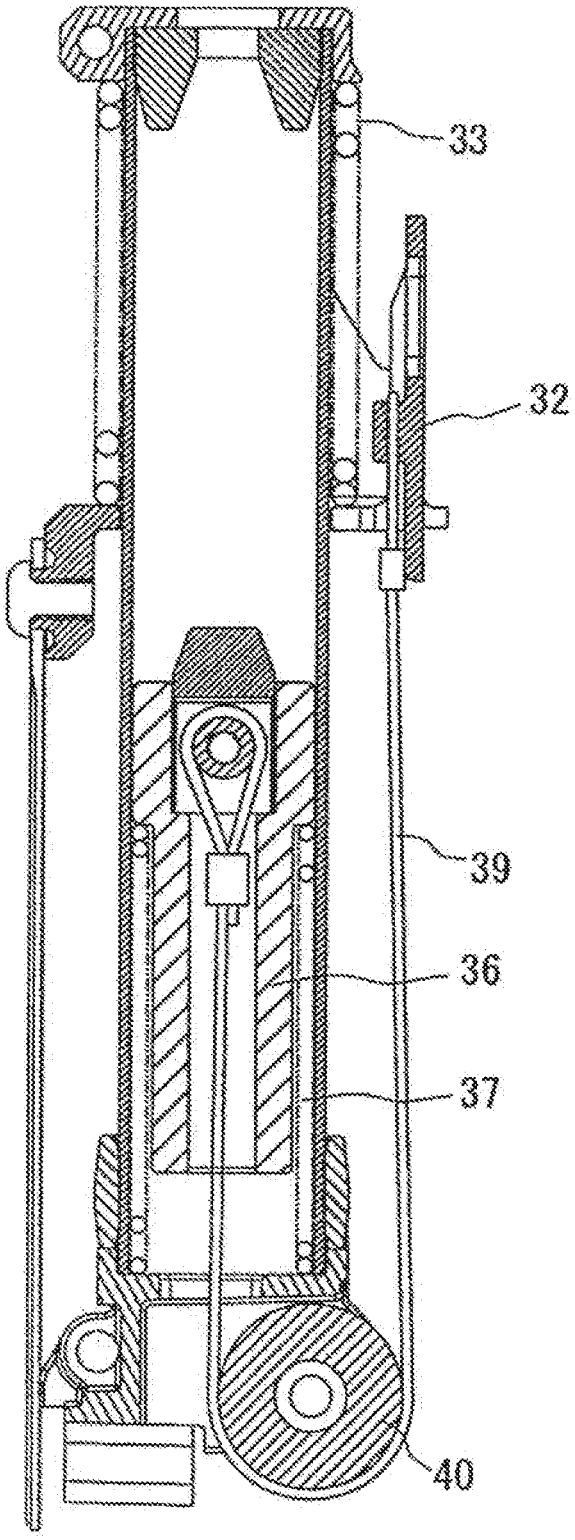
FIG. 8 is a section view of the plunger unit, showing a state where the plunger exists at its top dead center position.

FIG. 8 shows a state where the plunger 32 is pushed up by the drive mechanism 20 and exists at its top dead center position. In this state, the plunger is pushed up in the direction away from the nozzle 16 against the biasing force of the plunger biasing member 33. Also, as the plunger 32 is pushed up, the wire 39 is pulled and the balancer 36 connected to the other end of the wire 39 is pulled toward the nozzle 16 against the biasing force of the balancer biasing member 37.

Figure 12:
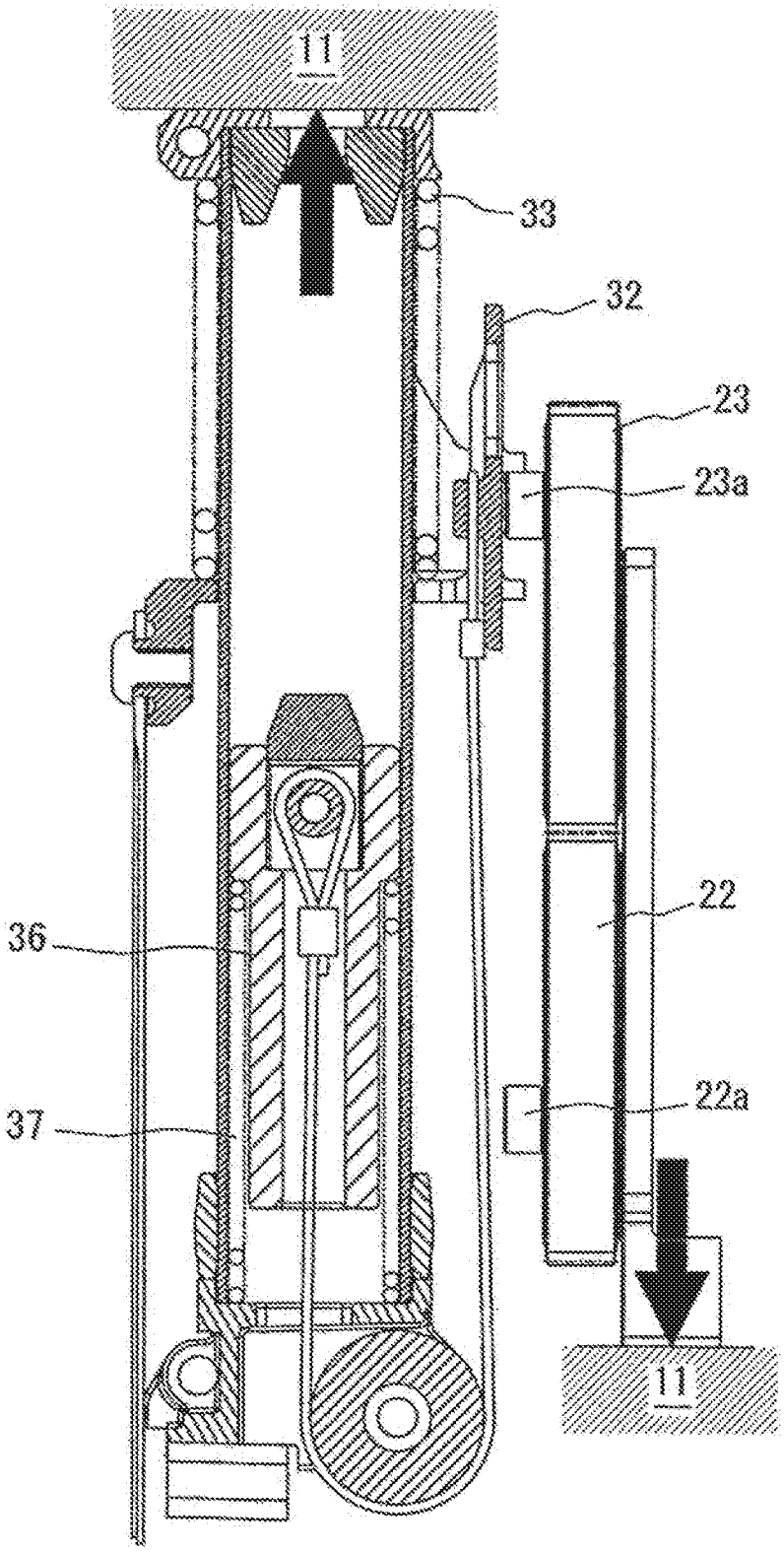
FIG. 12 is an explanatory view to show the equilibrium of forces when the plunger exists at its top dead center position.

In this state, as shown in FIG. 12, the housing 11 receives the biasing forces of the plunger biasing member 33 and balancer biasing member 37, while the forces balance with each other.

Figure 9:
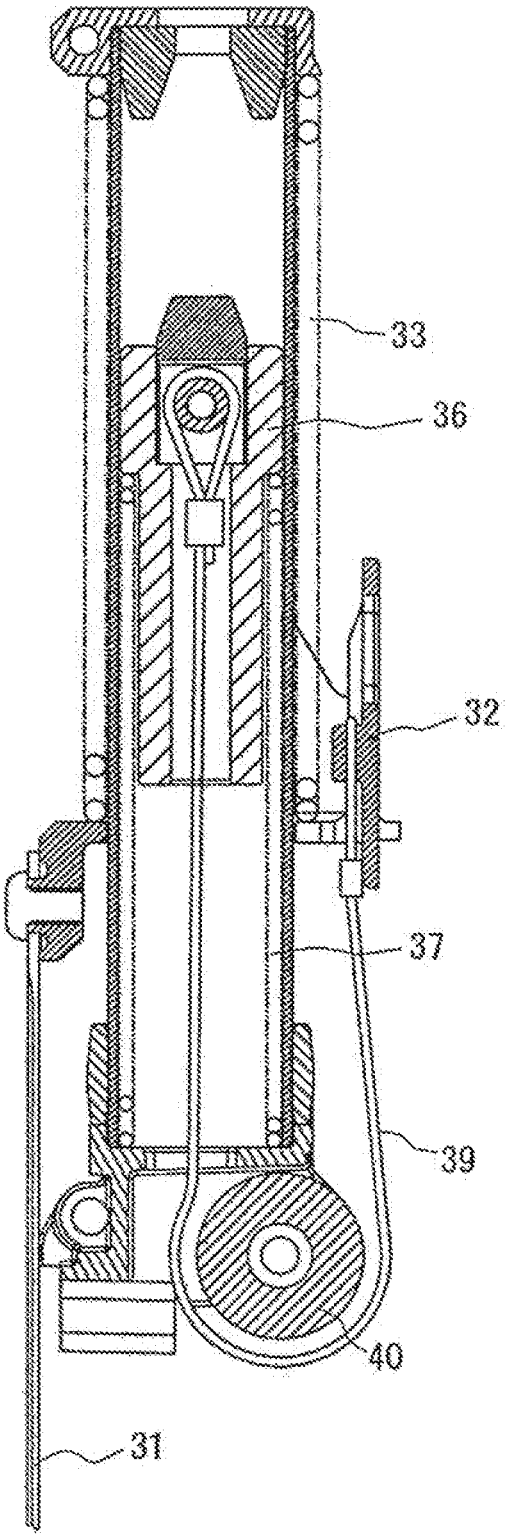
FIG. 9 is a section view of the plunger unit, showing a state where the plunger is moving from the top dead center position to the bottom dead center position.

In the state of FIG. 8, when the engagement between the plunger 32 and drive mechanism 20 is removed, as shown in FIG. 9, the biasing force of the plunger biasing member 33 allows the plunger 32 to start to move toward the nozzle 16. Thus, since the wire 39 pulling the balancer 36 is loosened, the balancer 36 is free and the biasing force of the balancer biasing member 37 allows the balancer 36 to start to move in the direction away from the nozzle 16.

Figure 13:
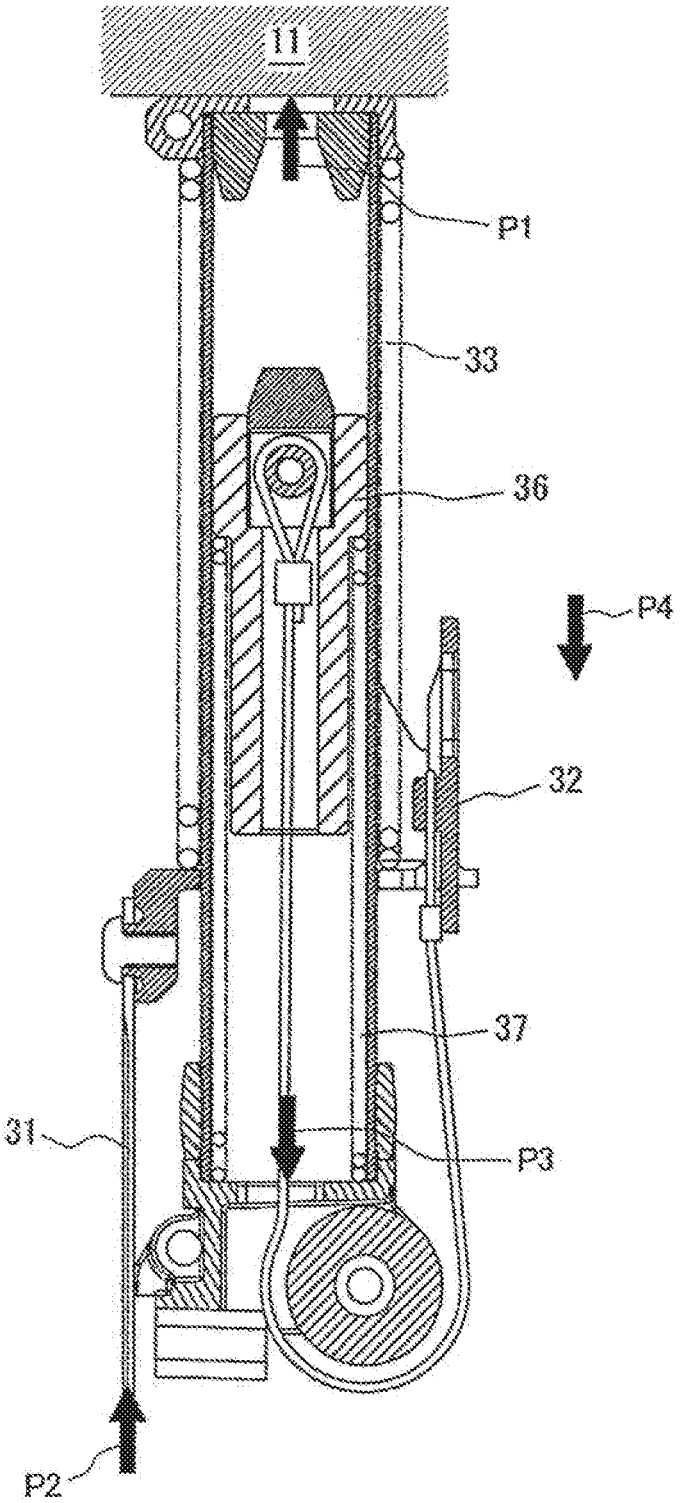
FIG. 13 is an explanatory view to show a reaction amount in a state where the plunger is moving from the top dead center position to the bottom dead center position.

In this case, as shown in FIG. 13, the biasing reaction P1 of the plunger biasing member and driving reaction P2 generate the reaction on driving which provides a force to part the driving tool 10 away from the workpiece.

However, in the driving tool 10 of this embodiment, due to the biasing reaction P3 of the balancer biasing member, there is applied a force to press the driving tool 10 against the workpiece. That is, since the balancer biasing member 37 biases the balancer 36 in the direction away from the nozzle 16, on the opposite side to the balancer 36, there is generated a reaction in a portion for receiving the balancer biasing member 37. That is, there is generated a force to press the workpiece against the housing 11 of the driving tool 10.

Therefore, the biasing reaction P1 of the plunger biasing member and driving reaction P2 cancel the biasing reaction P3 of the balancer biasing member, thereby reducing the reaction on driving. Here, a reaction, which cannot be cancelled by the biasing reaction P3 of the balancer biasing member, is to be cancelled by a pressing load P4 given by an operator (a mechanical weight can also be added thereto).

The loosening of the wire 39 in the driving operation is provided because the moving speed of the plunger 32 is set faster than the moving speed of the balancer 36. That is, by adjusting the difference between the biasing forces of the plunger biasing member 33 and balance biasing member 37 or the weights or sliding resistances of the plunger 32 and balancer 36, the moving speed of the plunger 32 is set faster than the moving speed of the balancer 36. Therefore, the wire 39 can be loosened due to the difference between these speeds.

Figure 10A:
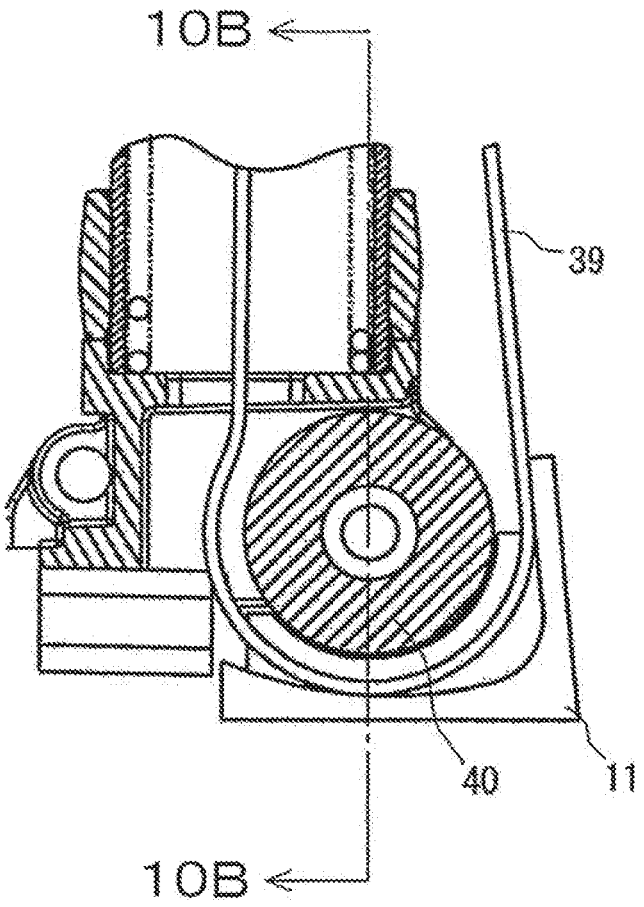
FIG. 10(*a*) is a partially enlarged section view of the plunger unit near to a pulley, showing a state where the plunger is moving from the top dead center position to the bottom dead center position.
Figure 10B:
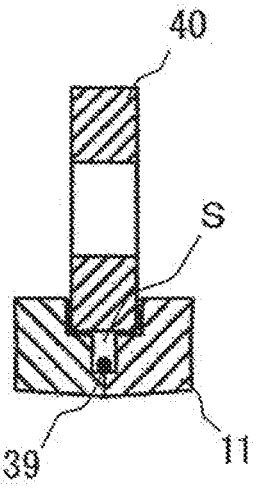

The wire 39, as shown in FIG. 10(*a*), is loosenably looped on a pulley 40 and is guided using a space S formed by the housing 11. Therefore, since, even when the loosened wire 39 comes off the pulley 40, it is guided by the space S, it is prevented from being caught by other portions.

Figure 11:
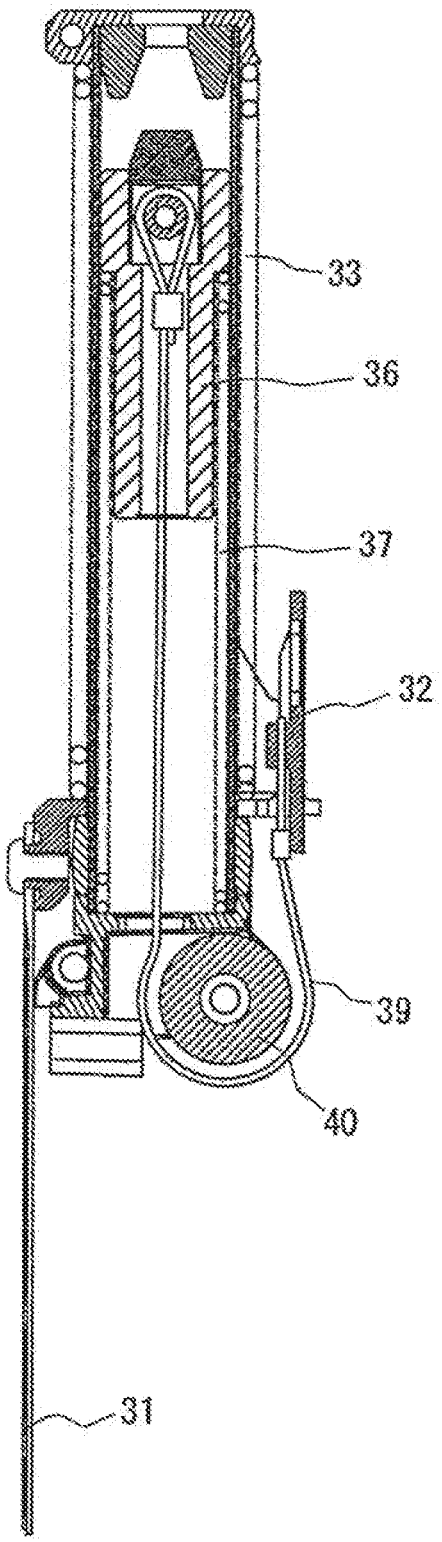
FIG. 11 is a section view of the plunger unit, showing a state just after the plunger has reached the bottom dead center position from the top dead center position.

FIG. 11 shows a state just after the plunger 32 moves further from the state of FIG. 9 and reaches the bumper 41 (just after the nail driving operation is ended). As shown in FIG. 11, just after the plunger 32 reaches the bumper 41, the balancer 36 has not reached the balancer stopper 38 but it is caused to move on due to the biasing force of the balancer biasing member 37. That is, since the moving speed of the plunger 32 is set faster than the moving speed of the balancer 36, after the plunger 32 reaches the bumper 41, the balancer 36 reaches the balancer stopper 38. When the balancer 36 reaches the balancer stopper 38, the plunger unit 30 returns to the state of FIG. 7.

In this embodiment, since there is set a time lag between the stop timing of the plunger 32 and the stop timing of the balancer 36 in this manner, the impact absorption by the balancer 36 and balancer biasing member 37 (generation of the biasing reaction P3 of the balancer biasing member) is allowed to continue until the completion of the nail driving operation. Also, although a force is applied in the reaction direction due to impacts caused by the balancer 36 colliding with the balancer stopper 38, the generating timing of this reaction is set after completion of the nail driving operation.

In accordance with the above embodiment, a driving tool may include: a driver 31 provided to be slidable toward a nozzle 16 formed in a leading end of the tool 10 and adapted to drive out a fastener from the nozzle 16; a balancer 36 provided to be slidable with respect to a housing 11 of the tool 10; and a balancer biasing member 37 adapted to bias the balancer 36 in a direction away from the nozzle 16. The balancer 36 may be adapted to move in the direction away from the nozzle 16 by a biasing force of the balancer biasing member 37, in accordance with a sliding movement of the driver 31 toward the nozzle 16.

According to this structure, in the driving time, although there is applied a force to the driving tool 10 in a direction away from the workpiece, at the same time, due to the biasing reaction of the balancer biasing member 37 applied to the balancer 36, there is applied a force in a direction to press the driving tool 10 against the workpiece. That is, "the force applied to the driving tool 10 in the direction away from the workpiece" and "the force applied in the direction to press the driving tool 10 against the workpiece" cancel each other, thereby being able to absorb the reaction on driving. Therefore, since a sufficient driving force can be obtained with a small pressing force against the workpiece, the fatigue of an operation can be reduced. Also, it is hard to raise a problem that the driver 31 can be caused to come off the nail due to the reaction and thus can damage the workpiece.

The balancer biasing member 37 may include a spring mechanism which is adapted to accumulate the biasing force when the driver 31 moves in the direction away from the nozzle 16.

According to this structure, the spring force thereof can generate the "force pressing the tool toward the workpiece".

The balancer 36 may be structured to be pulled toward the nozzle 16 through a string-shaped member 39 when the driver 31 moves in the direction away from the nozzle 16.

According to this structure, it is possible to physically link the balancer 36 with the driver 31 and thus operate the balancer 36 to the driving operation.

The balancer 36 may slide parallel to the driver 31.

According to this structure, since "the force applied in the direction away from the workpiece" and "the pressing force applied toward the workpiece" are parallel and opposite in direction, the reaction on driving can be absorbed highly efficiently.

The driving tool may further include: a plunger 32 to which the driver 31 is connected; a plunger biasing member 33 adapted to bias the plunger 32 toward the nozzle 16; a drive mechanism 20 adapted to drive the plunger 32 in the direction away from the nozzle 16 against a biasing force of the plunger biasing member 33 and to release the plunger 32 located in a position away from the nozzle 16 so that the driver 31 moves toward the nozzle 16 by the biasing force of the plunger biasing member 33 and drives the fastener; a string-shaped member 39 that connects the balancer 36 and the plunger 32 to each other; and a direction changing portion 40 adapted to change a direction of a force applied to the string-shaped member 39. The balancer 36 may be adapted to be pulled by the string-shaped member 39 and to move toward the nozzle 16 in accordance with a movement of the plunger 32 in the direction away from the nozzle 16, and the balancer 36 may be also adapted to move in the direction away from the nozzle 16 by the biasing force of the balancer biasing member 37 in accordance with a movement of the plunger 32 toward the nozzle 16 when the plunger 32 is released.

According to this structure, the absorbing mechanism can absorb such reaction effectively.

The string-shaped member 39 (wire 39) may be loosenably looped on the direction changing portion 40 (pulley 40).

According to this structure, the balancer 36 will not be pulled by the plunger 32. Therefore, due to the loosened wire 39, the balancer 36 is released from the plunger 32 (wire 39) and is thereby allowed to operate independently. Thus, the balancer 36 can be biased by the biasing force of the balancer biasing member 37 without being obstructed by the plunger 32 (wire 39). The reaction to this biasing force generates a force to press the driving tool 10 toward the workpiece to thereby be able to absorb the reaction on driving.

The balancer 36 may be provided so as to be slidable within a pipe 35 (balancer guide 35, cylindrical member 35) which is provided parallel to the nail drive-out direction. On both sides of the pipe 35, there may be provided plunger guides 34 respectively for guiding the sliding movement of the plunger 32.

According to this structure, since the balancer 36 can be disposed inside the pipe 35 and the plunger 32 can be disposed outside the pipe 35, the plunger unit 30 with a reaction absorbing mechanism can be made compact, its manufacturing cost can be reduced and the size of a product can also be reduced.

The plunger unit 30 may be fixed within the housing 11 in such a manner that the driver 31 is most distant from the grip 13. That is, the balancer 36 may be disposed nearer to the grip 13 than the driver 31.

According to this structure, since the driver 31 can be situated as near as possible to the counter-grip-13 side, it is not necessary to provide an extra projection on the counter-grip-13 side. No provision of a projection on the counter-grip-13 side makes it possible to use the nose portion 15 as near as possible to the wall surface. Therefore, for example, the plunger unit 30 can be applied to a finishing driving tool which is required to be able to drive a nail into an edge.

The balancer 36 may be adapted to continue its movement, even after the nail driving operation by the driver 31 is completed.

According to this structure, since the ending timing of the reaction absorption by the balancer 36 can be set later than the completion of the nail driving operation by the driver 31, the reaction absorbing mechanism can be positively operated up to the completion of the nail driving operation.

Figure 14A:
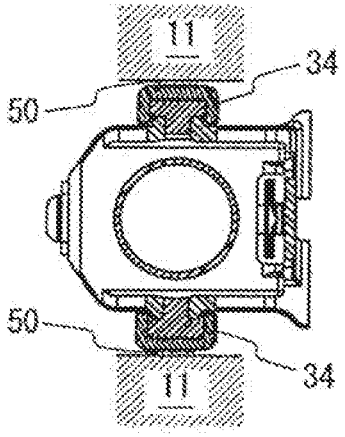
FIG. 14(*a*) is a section view taken along 14A-14A line shown in FIG. 14(*b*).
Figure 14B:
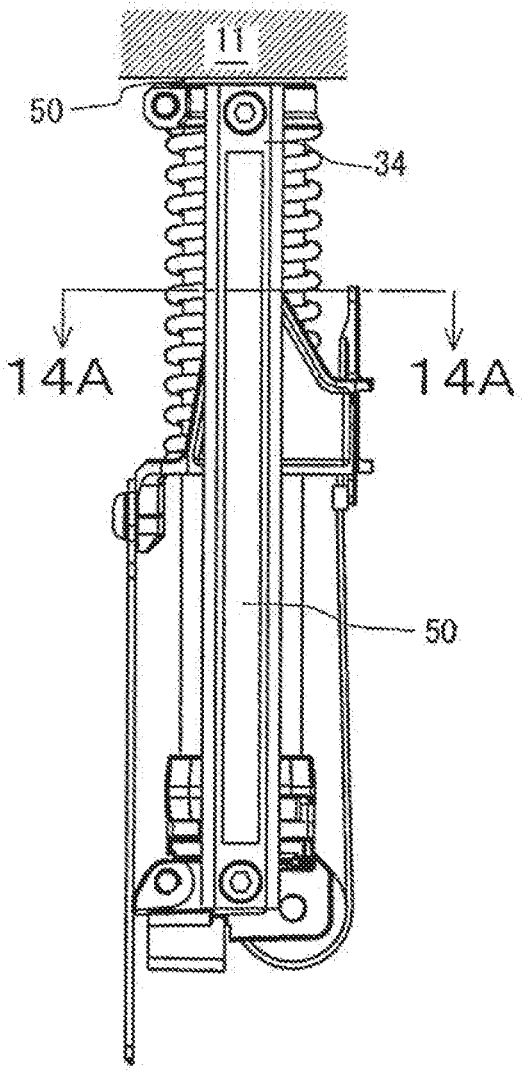

As shown in FIG. 14, when fixing the plunger unit 30 to the housing 11, a vibration isolator 50 may also be interposed between the plunger unit 30 and housing 11. The vibration isolator 50 may be made of resilient material such as rubber or urethane.

Specifically, as shown in FIGS. 14(*a*) and 14(*b*), the vibration isolator 50 can be provided, for example, between the plunger guides 34 and housing 11 or on a contact portion between the plunger unit 30 and the housing 11 at an opposite side of the nozzle 16.

Provision of such vibration isolator 50 can restrict the vibrations of the plunger unit 30 in operation (such as the vibrations of the plunger biasing member 33 and balancer biasing member 37, vibrations to be generated due to the sliding movements of the plunger 32 and balancer 36, and vibrations to be generated due to the collision of the plunger 32 and bumper 41). Thus, noises to be generated when driving a nail can be reduced.

Here, in the above embodiment, although description has been given of an example using a spring drive type nailing machine to be driven by a spring force, the invention is not limited to this but it can also be applied a tool to be driven by other drive source such as compressed air, electricity or the like.

In the above embodiment, although the compression spring is used as the balancer biasing member 37, this is not limitative but a tensile spring may also be used. And, other biasing means than the spring may also be used provided that it can generate a reaction. For example, an elastic member other than a spring may be used, electric or magnetic means may be used, or biasing means using hydraulic pressure or the like may be used.

In the above embodiment, although the balancer 36 is structured to slide parallel to the driver 31, this is not limitative but it may also be structured to slide with a certain angle relative to the sliding direction of the driver 31.

In the above embodiment, although the moving speed of the plunger 32 is set faster than the moving speed of the balancer 36, this is not limitative. The moving speed of the plunger 32 and the moving speed of the balancer 36 may also be set equal, or the moving speed of the plunger 32 may be set slower than the moving speed of the balancer 36.

In the above embodiment, although, in the driving operation, the plunger 32 and balancer 36 start to move simultaneously, this is not limitative. For example, by loosening the wire 39 in a state where the plunger 32 exists at its top dead center position, the movement of the balancer 36 can be set later than the movement of the plunger 32.

In the above embodiment, although the balancer 36 and plunger 32 are connected by the wire 39, this is not limitative. For example, the balancer 36 and plunger 32 may also be connected by a belt.

Figure 15:
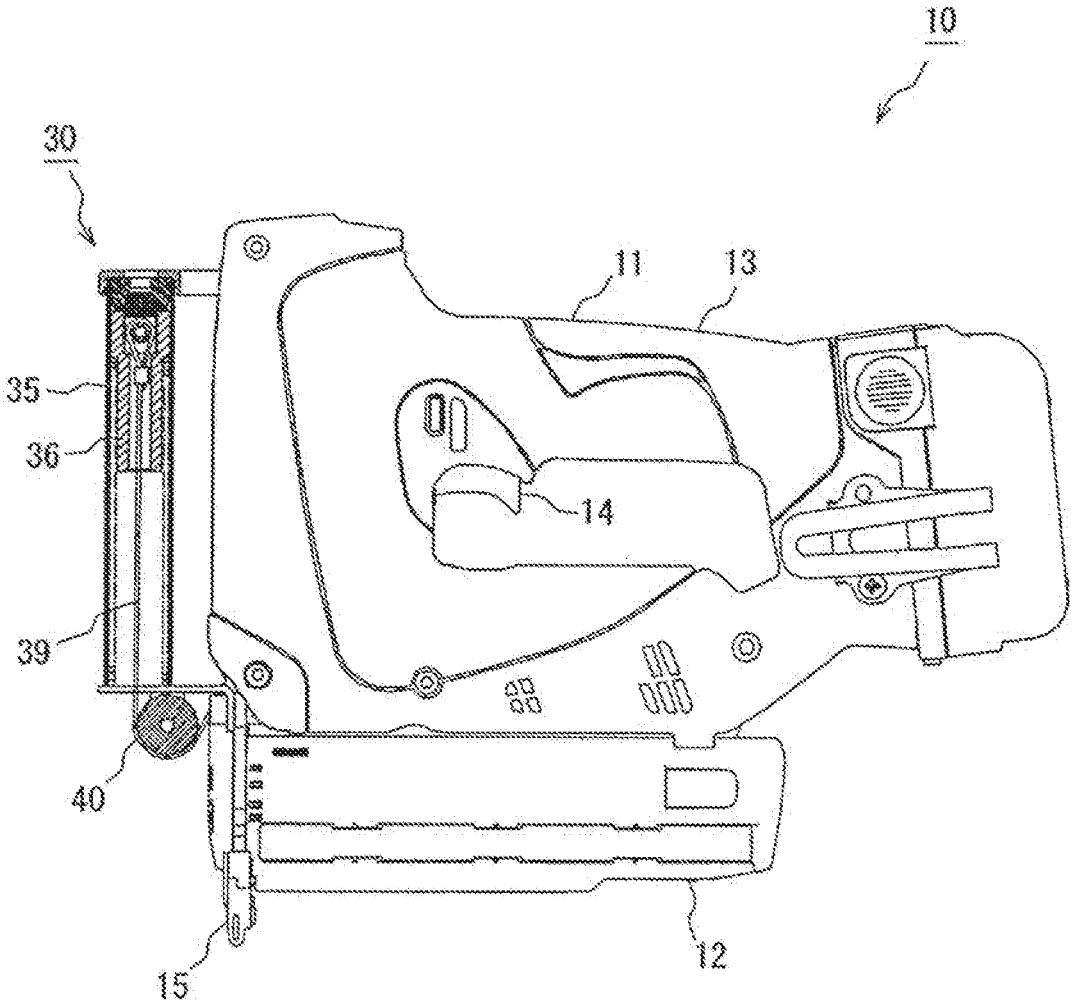
FIG. 15 shows a second modification of the embodiment, showing a driving tool with a balancer disposed outside its housing.

In the above embodiment, although the plunger unit 30 is disposed within the housing 11, this is not limitative. For example, as shown in FIG. 15, the balancer 36 may also be disposed outside the housing 11. Also, the whole plunger unit 30 may be disposed outside the housing 11. In this case, the whole plunger unit 30 may also be covered with other case than the housing 11.

Figure 16:
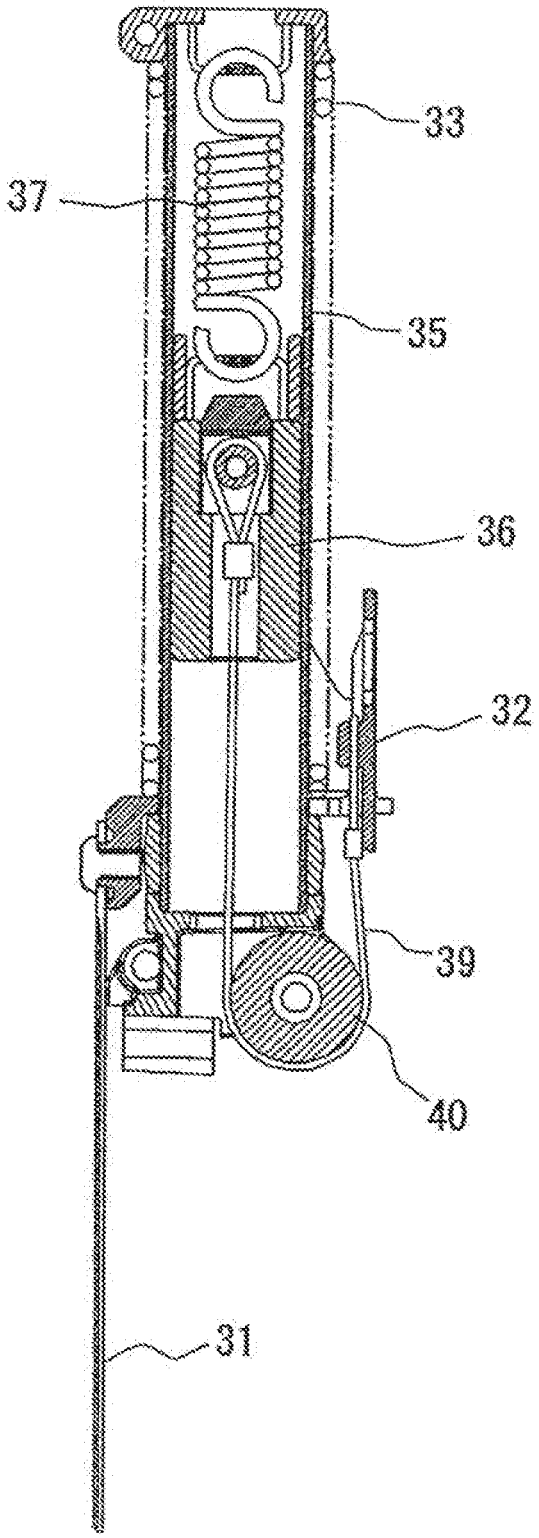
FIG. 16 shows a third modification of the embodiment. Specifically, it is a section view of a plunger unit including a tensile spring as a balancer biasing member.
Figure 17:
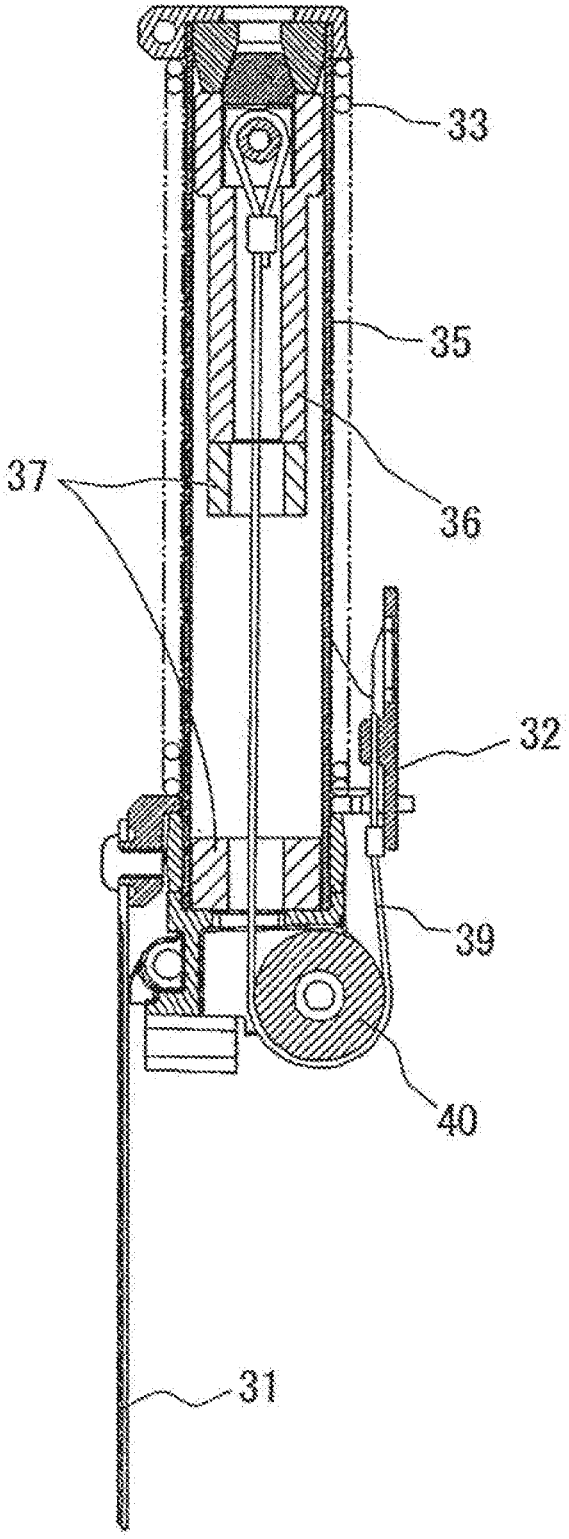
FIG. 17 shows a fourth modification of the embodiment. Specifically, it is a section view of a plunger unit including a magnetic spring as a balancer biasing member.

In the above embodiment, although the compression spring is used as the balancer biasing member 37, this is not limitative. For example, as shown in FIG. 16, a tensile spring may also be used as the balancer biasing member 37. Also, as shown in FIG. 17, a magnetic spring (a member in which two mutually repelling magnets are disposed opposed to each other) may also be used as the balancer biasing member 37.

In the above embodiment, although the wire 39 is used as the string-shaped member, this is not limitative. For example, a belt, a strip cloth, a string or a cord may also be used.

Figure 18:
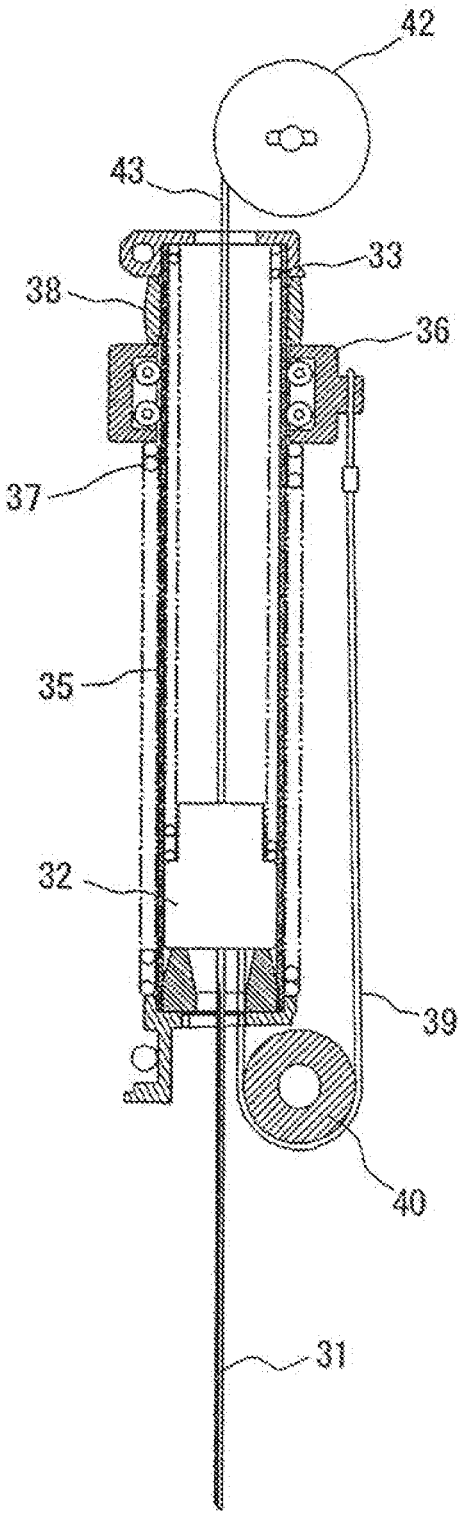
FIG. 18 shows a fifth modification of the embodiment. Specifically, it is a section view of a plunger unit with a balancer disposed outside its pipe.

In the above embodiment, although the balancer 36 is structured to slide inside the pipe 35, this is not limitative. For example, as shown in FIG. 18, the balancer 36 may also be structured to slide outside the pipe 35. In this case, as the drive mechanism 20, there may be provided, for example, such a plunger hoisting mechanism 42 as shown in FIG. 18. That is, by operating the plunger hoisting mechanism 42 using a motor, a plunger hoisting wire 43 may be hoisted to thereby push up the plunger 32 against the biasing force of the plunger as biasing member 33.

In the above embodiment, although the cylindrical pipe 35 is used as a balancer guide for guiding the balancer 36, this is not limitative. For example, as shown in FIG. 19, there may also be used a balancer guide 35 shaped to be able to guide the balancer 36 while sandwiching it from both sides at two or more points.

Figure 19A:
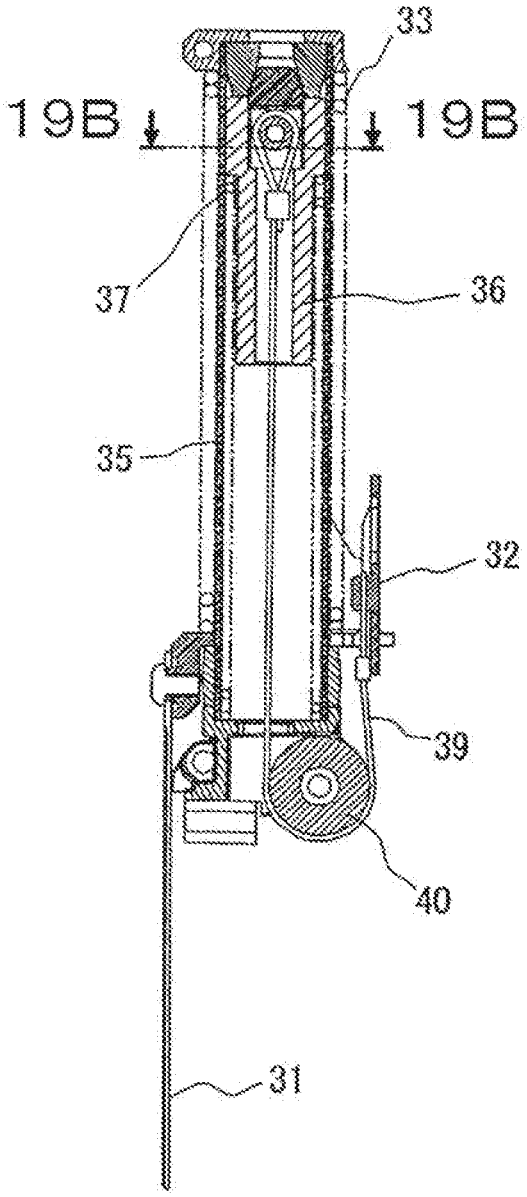
FIG. 19 (*a*) is a side section view of a plunger unit including a balancer guide having a different shape according to a sixth modification of the embodiment.
Figure 19B:
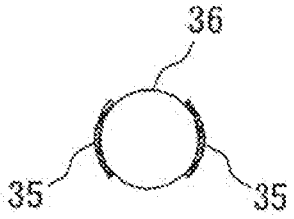

Here, in the example of FIG. 19, although the balancer guide 35 has a substantially arc-like shape following the outer periphery of the balancer 36, the range containing the sandwiching contact points may be reduced in size and thus the balancer may have a rectangular shape instead of the arc-like shape.

In the above embodiment, although the pulley 40 is used as the direction changing portion, this is not limitative. For example, a string-shaped member may be simply slid along the edge portion of a given member, whereby such edge portion may be used as the direction changing portion.

Figure 20C:
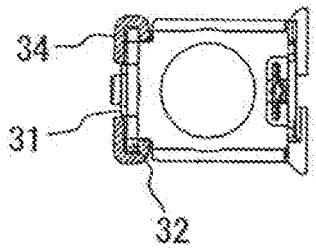
FIGS. 20(*a*) to 20(*c*) shows a seventh modification of the embodiment. Specifically, FIG. 20(*a*) is a front view of a plunger unit with a plunger guide disposed only one side of a pipe.
Figure 20A:
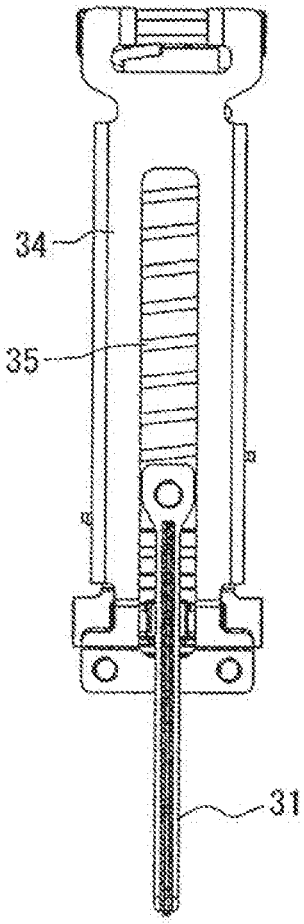
Figure 20B:
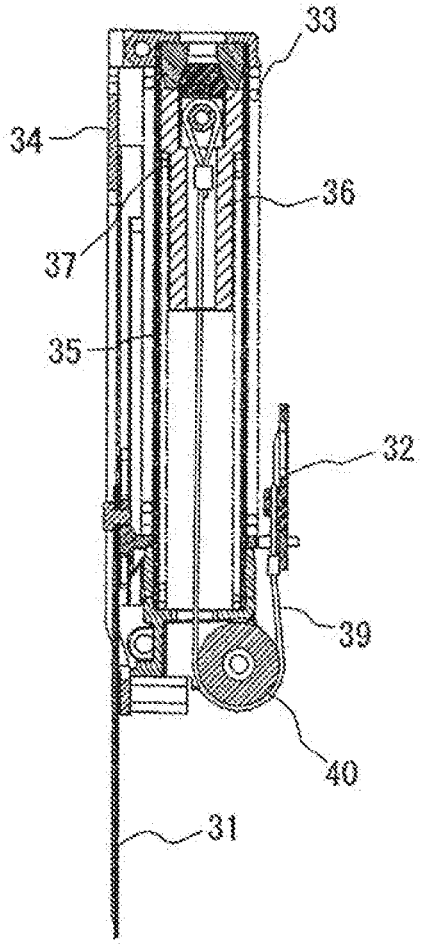

In the above embodiment, although the plunger guides 34 for guiding the sliding movement of the plunger 32 are disposed on both sides of the cylindrical portion (pipe 35), this is not limitative. For example, as shown in FIG. 20, a plunger guide 34 for guiding the sliding movement of the plunger 32 may also be disposed on only one side of the cylindrical portion (pipe 35). Or, as many as possible plunger guides may be provided on the periphery of the cylindrical portion (pipe 35) to thereby enhance the guide performance.

Figure 21:
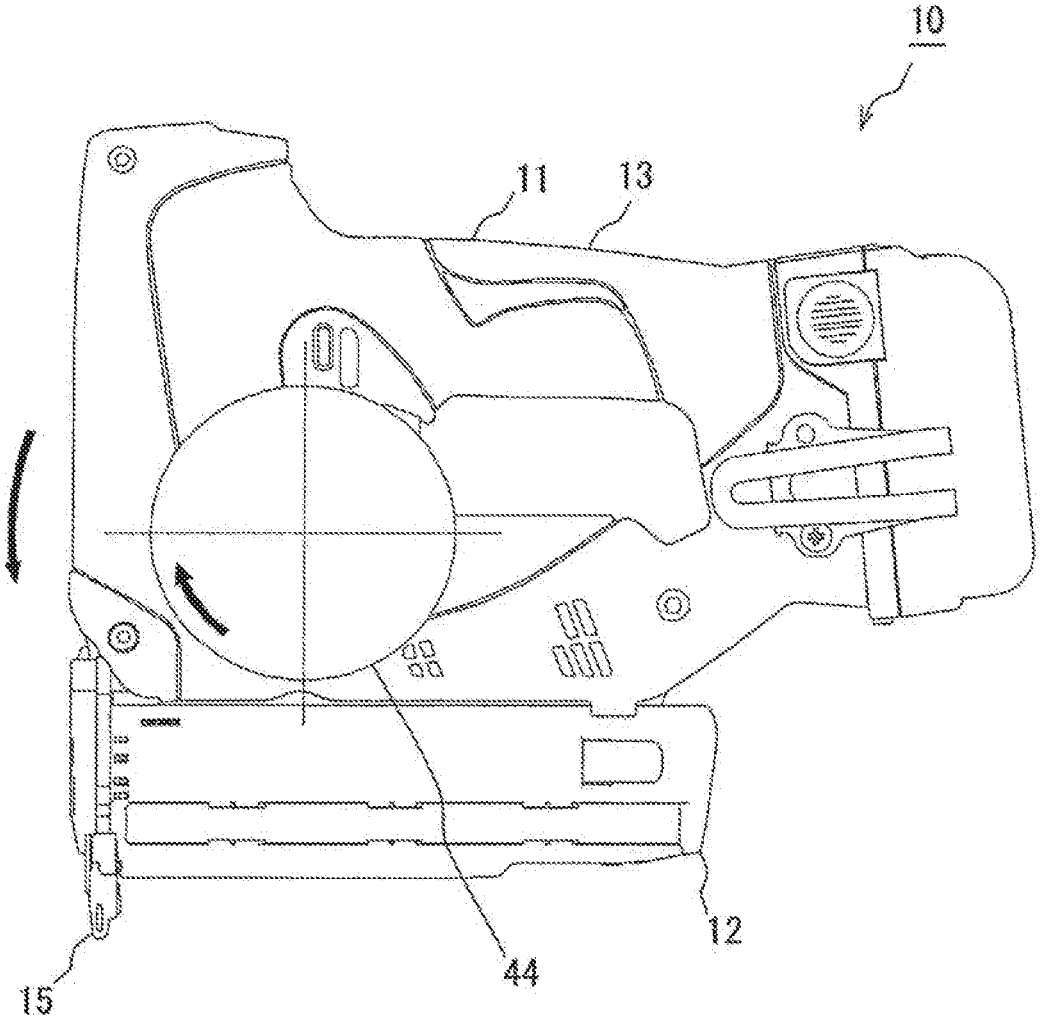
FIG. 21 shows a fifth modification of the embodiment, where a driving tool using a flywheel is employed.

As shown in FIG. 21, a flywheel mechanism may also be used to absorb the reaction. That is, as shown in FIG. 21, there is provided a flywheel 44 which rotates in a clockwise direction in the vicinity of the central portion of the main body of the driving tool 10. And, as shown in FIG. 21, when, simultaneously with the driving operation, the flywheel 44 is rotated in a direction where its front side (driver 31 side) is raised, due to the reaction thereof, the main body of the driving tool 10 receives a rotation force in the opposite direction (a direction where its front side is lowered). Therefore, this rotation force and the reaction on driving cancel the floating force of the main body of the driving tool 10, thereby being able to reduce the reaction on driving.

The flywheel 44 may be adapted to rotate such that the rotational movement of the flywheel 44 is independent from the straight-going movement of the driver 31. In contrast, the flywheel 44 may be rotated in linking with the driver 31. For example, using a rack belt or a wire, the straight-going movement of the driver 31 may be converted to the rotational movement of the flywheel 44, whereby the flywheel 44 may be rotated in linking with the driving operation of the driver 31. Also, as the rotation center of the flywheel 44 becomes nearer to the center of gravity of the main body of the driving tool 10, the flywheel rotates nearer around the center of gravity, thereby being able to absorb the reaction more effectively. Therefore, preferably, the rotation center of the flywheel 44 may be set as near as possible to the center of gravity of the main body of the driving tool 10.

DESCRIPTION OF REFERENCE NUMERALS AND SIGNS

10: Driving tool
11: Housing
12: Magazine
13: Grip
14: Trigger
15: Nose portion
16: Nozzle
17: Motor
20: Drive mechanism
21: Torque gear plate
22: First torque gear

22*a*: Torque roller
23: Second torque gear
23*a*: Torque roller
30: Plunger unit
31: Driver
32: Plunger
32*a*: Guide roller
32*b*: Driver connecting portion
32*c*: First engaging portion
32*d*: Second engaging portion
32*e*: Pipe hole
33: Plunger biasing member
34: Plunger guide
34*a*: Rail portion
35: Pipe (balancer guide)
36: Balancer
37: Balancer biasing member
38: Balancer stopper
39: Wire (string-shaped member)
40: Pulley (direction changing portion)
41: Bumper
42: Plunger hoisting mechanism
43: Plunger hoisting wire
44: Flywheel
50: Vibration isolator
S: Space
P1: Biasing reaction of plunger biasing member
P2: Driving reaction
P3: Biasing reaction of balancer biasing member
P4: Operator's pressing load

What is claimed is:

1. A driving tool comprising:

a driver provided to be slidable toward a nozzle formed in a leading end of the tool and adapted to drive out a fastener from the nozzle;

a plunger to which the driver is connected;

a plunger biasing member adapted to bias the plunger toward the nozzle; and a balancer adapted to absorb a reaction on driving;

wherein the balancer is adapted to move in a direction away from the nozzle by a starting movement of the plunger toward the nozzle, and wherein a biasing reaction generated by the balancer and a biasing reaction generated by the plunger biasing member are collinear.

2. The driving tool according to claim 1, wherein a starting time of a movement of the balancer is later than a starting time of the movement of the plunger.

3. The driving tool according to claim 2, further comprising:

a bumper against which the plunger is pressed on driving; and balancer stopper against which the balancer is pressed on driving, wherein, after the plunger reaches the bumper, the balancer reaches the balancer stopper.

4. The driving tool according to claim 1, further comprising:

a bumper against which the plunger is pressed on driving; and a balancer stopper against which the balancer is pressed on driving, wherein, after the plunger reaches the bumper, the balancer reaches the balancer stopper.

* * * * *